United States Patent [19]

Stubbs

[11] 4,114,011

[45] Sep. 12, 1978

[54] MICROWAVE HEATING METHOD AND APPARATUS

[75] Inventor: Elmer L. Stubbs, Colorado Springs, Colo.

[73] Assignee: Thermatron, Inc., Denver, Colo.

[21] Appl. No.: 704,520

[22] Filed: Jul. 12, 1976

[51] Int. Cl.[2] ..... H05B 9/06

[52] U.S. Cl. ..... 219/10.55 M; 219/10.55 R; 219/10.55 A

[58] Field of Search ..... 219/10.55 R, 10.55 A, 219/10.55 M, 10.55 E, 10.55 F, 10.51; 165/136

[56] References Cited

U.S. PATENT DOCUMENTS

| | | | |
|---|---|---|---|
| 2,978,562 | 4/1961 | Fox | 219/10.55 R |
| 3,461,260 | 8/1969 | Brewer | 219/10.55 F |
| 3,494,724 | 2/1970 | Gray | 219/10.55 R |
| 3,778,578 | 12/1973 | Long et al. | 219/10.55 R |
| 3,816,689 | 6/1974 | Long | 165/136 |
| 3,891,817 | 6/1975 | Brown | 219/10.55 R |
| 3,920,945 | 11/1975 | Smith et al. | 219/10.55 R |
| 3,946,187 | 3/1976 | MacMaster | 219/10.55 E |

*Primary Examiner*—Bruce A. Reynolds
*Attorney, Agent, or Firm*—Ancel W. Lewis, Jr.

[57] ABSTRACT

Microwave heating method and apparatus for heating a room and like spaces wherein microwave energy is used to heat a fluid medium passed through a microwave energy absorptive chamber with energy reflective walls into which the energy is radiated and contained, and the fluid medium so heated is passed from the absorptive chamber and used to transfer the heat to a room or like space. In one form of the invention disclosed a microwave energy absorbent liquid passed through the absorptive chamber directly receives and converts the microwave energy to heat in the liquid. In another form a microwave energy absorbent body has pipe sections for conducting a liquid through the body and the body heated by the microwave energy transfers heat to a liquid flowing in the pipe sections. In yet another form a plurality of microwave energy absorbent bodies are heated by microwave energy and a liquid is passed over the heated bodies to receive heat therefrom. In a further form of the invention disclosed a plurality of microwave energy absorbent bodies are heated by the microwave energy and a flow of air is passed over the heated bodies to receive heat therefrom. An arrangement of the microwave energy absorbent substance in a parabolic configuration with the output of the source of microwave energy at approximately the focal point is highly effective for increasing energy absorption by the absorbent substance.

6 Claims, 11 Drawing Figures

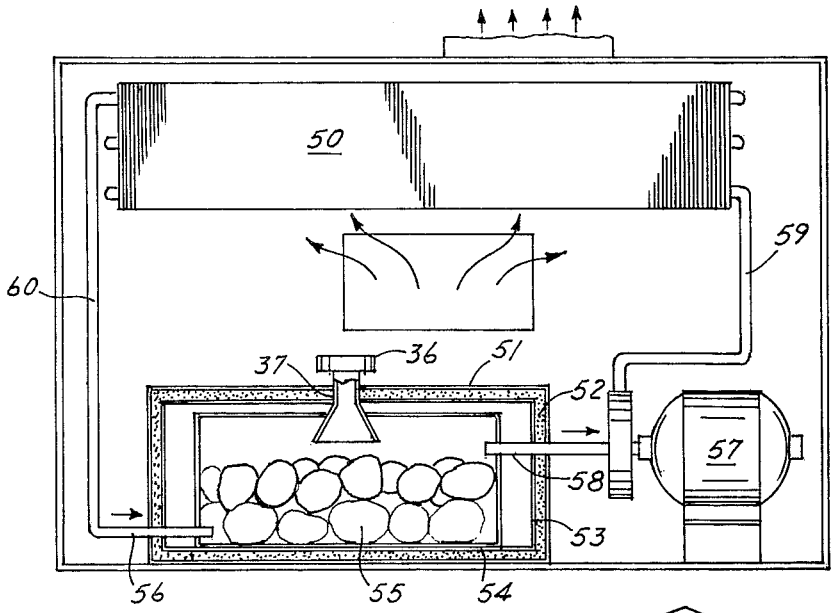
FIG. 8
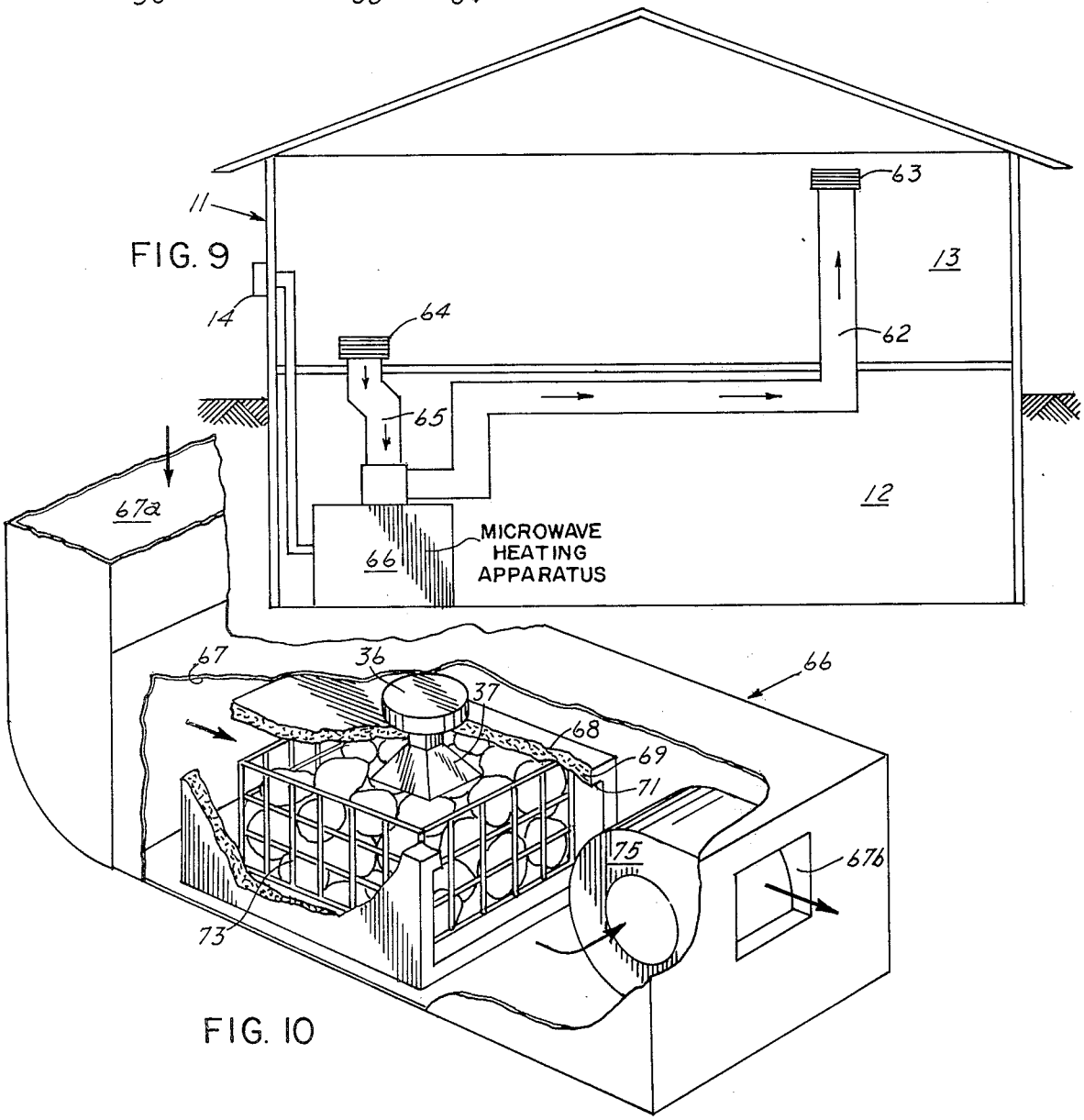
FIG. 9
FIG. 10

MICROWAVE HEATING METHOD AND APPARATUS

FIELD OF THE INVENTION

This invention relates to a novel microwave heating method and apparatus for room heating and the like.

BACKGROUND OF THE INVENTION

Heating systems for rooms and like spaces presently in common use employ a pressurized gas delivered in pipes or furnished in containers and a gas flame to heat air in a heat exchanger through which air is circulated. In another known heating system, hot water is heated by a boiler and circulated by pipes to a radiator located at various selected points in one or more rooms.

Some of the deficiencies in these presently known heating systems include bulk, cost of construction, inefficiency and hazards caused by the use of pressurized gas and a gas flame.

Accordingly, it is an object of the present invention to provide a simple, compact, reliable, low cost, and efficient heating apparatus that utilizes microwave energy for producing heat for heating a room and like spaces.

Another object of the present invention is to provide a novel microwave heating apparatus for a room and like spaces suitable for use in combination with heat distribution systems already existing in the building structures and the like.

A further object of the present invention is to provide a novel heating apparatus having improved heating characteristics over the various types of heating units presently in use which is pollution free or non-toxic, has no venting, no explosive agents, no flames, and is in the interest of energy conservation.

Yet another object of the present invention is to provide an energy saving heating apparatus for rooms and like spaces.

Still another object of the present invention is to provide a novel microwave heating apparatus that is versatile and highly flexible to accommodate a variety of heating requirements for rooms, building structures and the like.

Still a further object of the present invention is to provide a novel microwave heating apparatus that may be used as supplementary to other heating systems including solar heating systems.

Other objects, advantages and capabilities of the present invention will become more apparent as the description proceeds taken in conjunction with the accompanying drawings, in which like parts have similar reference numerals, and in which:

FIG. 8 is a sectional view of a portion of the microwave heating apparatus of FIG. 7;

FIG. 9 is a diagrammatic illustration of a building provided with microwave heating apparatus operated with heated flowing air embodying the present invention;

FIG. 10 is a perspective view of a portion of the microwave heating apparatus of FIG. 9.

Figure 1:
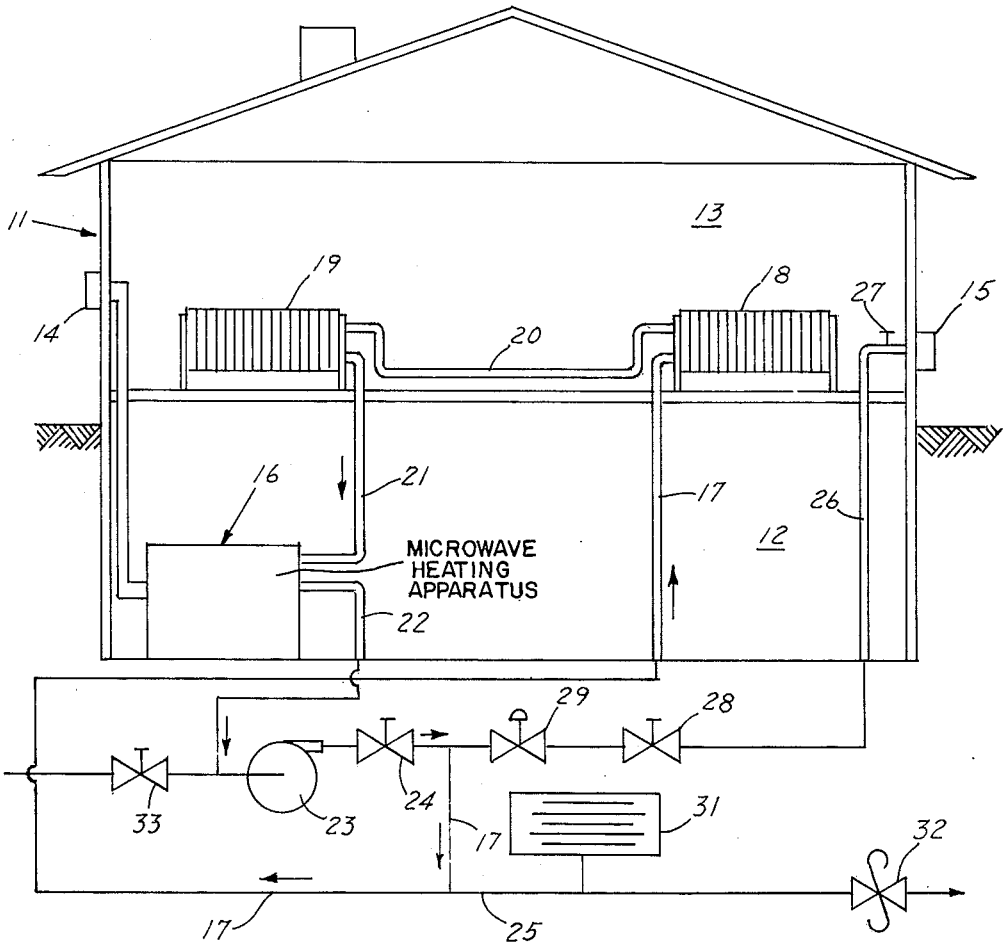
FIG. 1 is a diagrammatic illustration of a building provided with microwave heating apparatus operated with a heated flowing liquid embodying the present invention.

Referring now to the drawings, in FIG. 1 there is illustrated a building 11 having a lower level room 12 and an upper level room 13 and equipped with an electric outlet represented at 14 and a source of water 15. A microwave heating apparatus 16 operated with a flowing liquid is shown located within the room 12. The building is further shown as equipped with a fluid circulating and heat exchanger system shown as including two heat exchangers or radiators 18 and 19 in the upper room 13 with an inlet pipe 17 coupled to the inlet of radiator 18, an intermediate pipe 20 between radiators 18 and 19, and an outlet pipe 21 conducting flow from radiator 19.

The microwave heating apparatus 16 in general heats a microwave energy absorbent liquid that is circulated therethrough and the fluid circulating and heat exchanger system. The heated liquid is taken from apparatus 16 through an outlet pipe 22 and is pumped by a pump 23 through an on-off control valve 24 to the inlet flow line 17 for radiator 18. There is further provided a fill line 26 connected to a water tap 27 at source 15 via an on-off control valve 28 and a pressure regulator valve 29 that in turn connects by a tee coupling to line 17 which allows a venting of pressure in the flow line 17 to the atmosphere when the pressure in line 17 exceeds a selected maximum pressure such as 15 psi. Another flow line 25 is coupled to the delivery pipe at a tee coupling and has an expansion tank 31 and a safety valve 32 that releases at a selected maximum pressure such as 20 psi. Yet another air bleed valve 33 is coupled to the flow line 22 on the intake side of the pump 23 to blow off air to the atmosphere as required.

Figure 2:
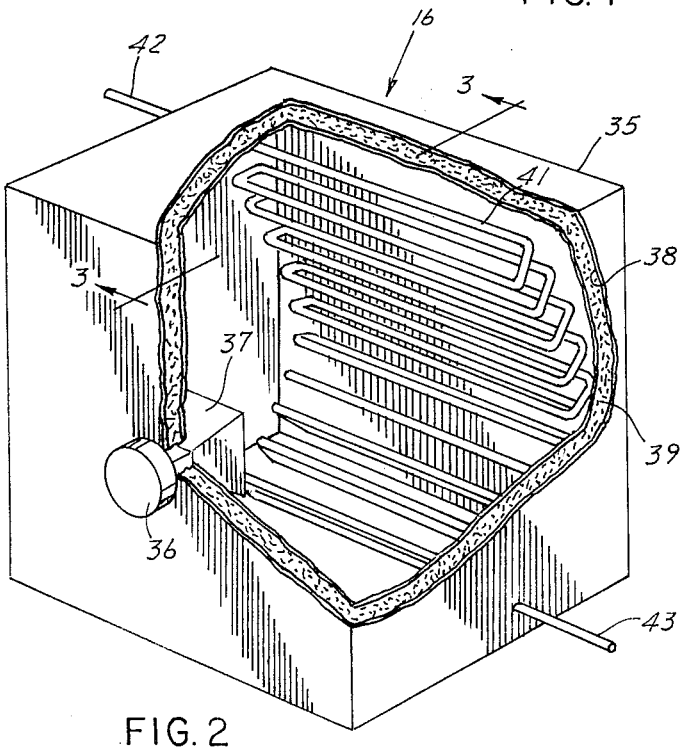
FIG. 2 is a perspective view of one form of microwave heating apparatus operated with a heated flowing liquid.
Figure 3:
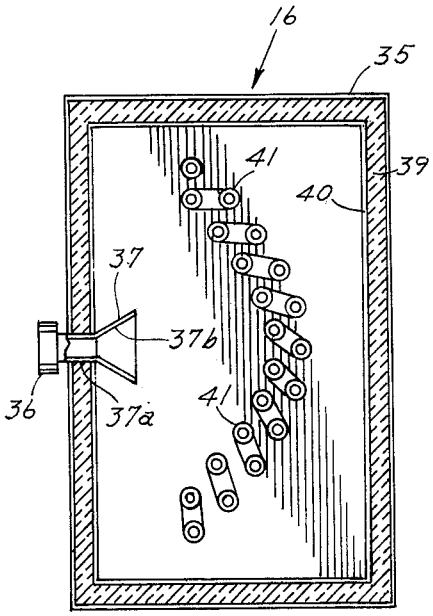
FIG. 3 is a sectional view taken along lines 3—3 of FIG. 2.

Referring now to FIGS. 2 and 3, the microwave heating apparatus 16 shown in more detail comprises an oblong housing or cabinet 35 forming an absorptive chamber in the inside thereof on which there is mounted a source of microwave energy 36 that is introduced into the chamber via a hollow wave guide 37. The wave guide 37 is designed for the frequency transmitted by the source 36 and has a hollow straight tubular section **37*a* of a generally rectangular shape and a hollow flared end section 37*b* of a generally rectangular shape. The microwave energy source or generator 36** may take the form of a magnetron tube or the equivalent thereof that will generate electromagnetic wave energy in the microwave region of the electromagnetic spectrum. The microwave band is between the radio wave band and the radar band and ranges from between about 2 to 100 cm in wavelength. The microwave oscillation rate is about 20,000 MHz to 400 MHz. In order to avoid interfering with radar and other forms of communication, the most commonly used microwave frequencies are 2450 MHz and 915 MHz.

The housing 35 shown has outer walls 38, a layer of heat insulation 39 within the outer walls, and inner walls 40. The outer walls 38 may be made of sheet metal for rigidity. The inner walls 40 define the limits of the absorptive chamber and are made of a material that reflects microwave energy, such as sheet metal.

The housing 35 contains a multi-pass pipe system that conveys a microwave energy absorbent liquid through the absorptive chamber. The pipe system is made up of a plurality of microwave-permeable internal pipe sections 41 connected in series and arranged in a parabolic array. More specifically, the vertical transverse cross section shows there to be a front row of pipe sections arranged along a parabolic curve and a rear row of pipe sections arranged along a parabolic curve. The front row of pipe sections are disposed at spaced intervals and the rear row of pipe sections are disposed at spaced intervals with the front row offset from the rear row in a zigzag pattern so that the microwave energy passing between the space of two pipe sections of the first row will strike a rear pipe section. There is an inlet pipe section 42 and an outlet pipe section 43 and the adjacent end portions of each pipe section are coupled with an end section so that there is a continuous flow of fluid through the pipe system from the inlet 42 to outlet 43. In this form the output of the microwave source 36 is at approximately the focal point of the parabolic array of pipe sections for maximum energy absorption by the microwave energy absorbent liquid being circulated through the pipe system.

The fluid medium passed through the pipe system must have dielectric properties so as to be capable of converting the microwave energy to heat contained in the fluid. Tap water would be suitable but more absorbent fluids may be utilized. A brine or salt water solution exhibits greater absorbent qualities than tap water. Other solutions may include chromium or carbon.

In the operation of the apparatus shown in FIGS. 1-4 the microwave energy is radiated from the source 36 and is directed by the wave guide 37 into the absorptive chamber defined by inner walls 40. This energy is absorbed by the fluid in the pipe sections and converted to heat contained in the fluid. The fluid acts as a shorted receiving antenna which converts the radiated microwave energy into a high circulatory current causing molecular excitation within the fluid resulting in an increase in the temperature of the fluid, sometimes referred to as molecular heating. The pump 23 serves to circulate the heated fluid through a radiator system to transfer the heat to a room or the like, and the fluid is recycled for reheating in the closed-loop system.

Figure 4:
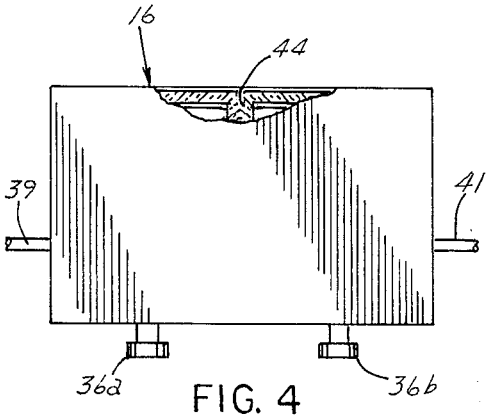
FIG. 4 is a top plan view of heating apparatus like FIG. 2 with dual energy sources.

In the modified form shown in FIG. 4 there are provided two sources of microwave energy **36*a* and 36*b* mounted in the housing 35 with an associated wave guide 37 for each source for introducing energy to the same arrangement of pipe sections. The chamber is divided into two sections by a wall 44**. In this arrangement there is a cross field effect for the energy whereby overall efficiency of the heating may be increased.

In the form of the invention shown in FIG. 5 there is again provided a source of microwave energy 36 and wave guide 37 mounted in the side of a housing with outer walls 38, a layer of heat insulation 39 and inner walls 40, as with the housing described with reference to FIGS. 2 and 3. Inside the housing there is provided an elongated, solid, microwave energy absorbent body 45 having a transverse cross section shaped in the form of a parabola with the output of the source 36 being located at approximately the focal point thereof. The energy-receiving surface of the solid body 45 is formed with a plurality of pyramid-shaped projections 46 projecting toward the source presenting four rather than a single flat surface that further enhance the absorption of the microwave energy to enhance the heating. Within the solid body 45 there is provided a pipe system with pipe sections 47 coupled in series at the ends that are made of a heat-conductive material such as copper and convey a liquid such as water in a continuous path similar to FIGS. 2–4 whereby the body absorbs the heat and it is conducted via the pipe sections 47 to the liquid, which is then pumped into a closed fluid-heating system such as that shown in FIG. 1. An inlet pipe section 48 and an outlet pipe section 49 convey the liquid to and from pipe sections 47. Although the body 45 has an inner energy receiving surface formed with a plurality of pyramid-shaped surfaces, it is understood that for some applications this surface may be smooth and follow a parabola.

Figure 5:
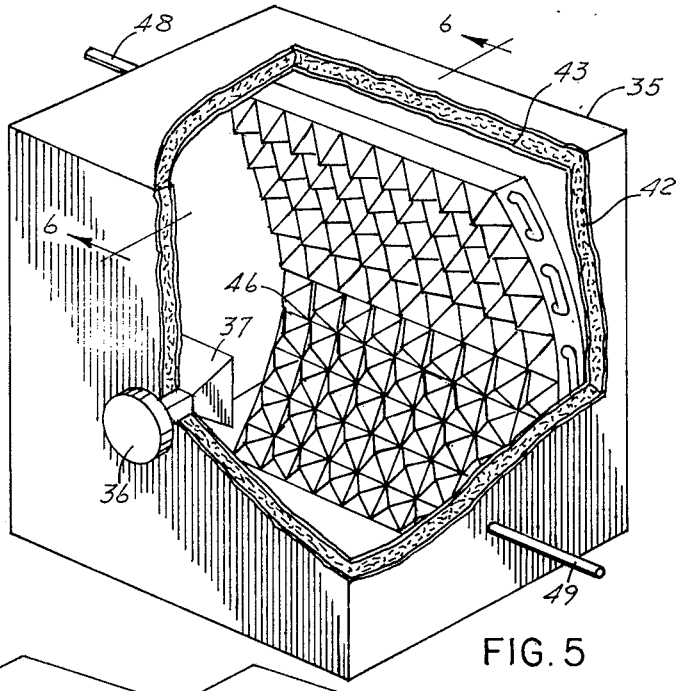
FIG. 5 is a perspective view of a modified form of heating apparatus from that shown in FIG. 2 using a solid absorbent body with pyramid faces.
Figure 6:
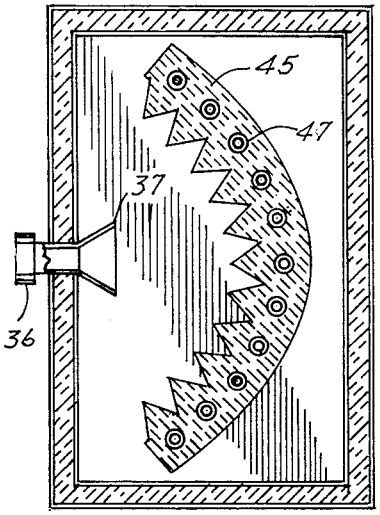
FIG. 6 is a sectional view taken along lines 6—6 of FIG. 5.

In the operation of the apparatus shown in FIGS. 5 and 6 the microwave energy is radiated from the source 36 and directed by the wave guide 37 into the absorptive chamber defined by inner walls 40. Then energy is absorbed by body 45 which becomes heated and the heat is conducted via pipe sections 47 to the liquid flowing therethrough, which in turn is pumped by a system like that shown in FIG. 1 to suitable radiators to transfer the heat to a room and like space.

Figure 7:
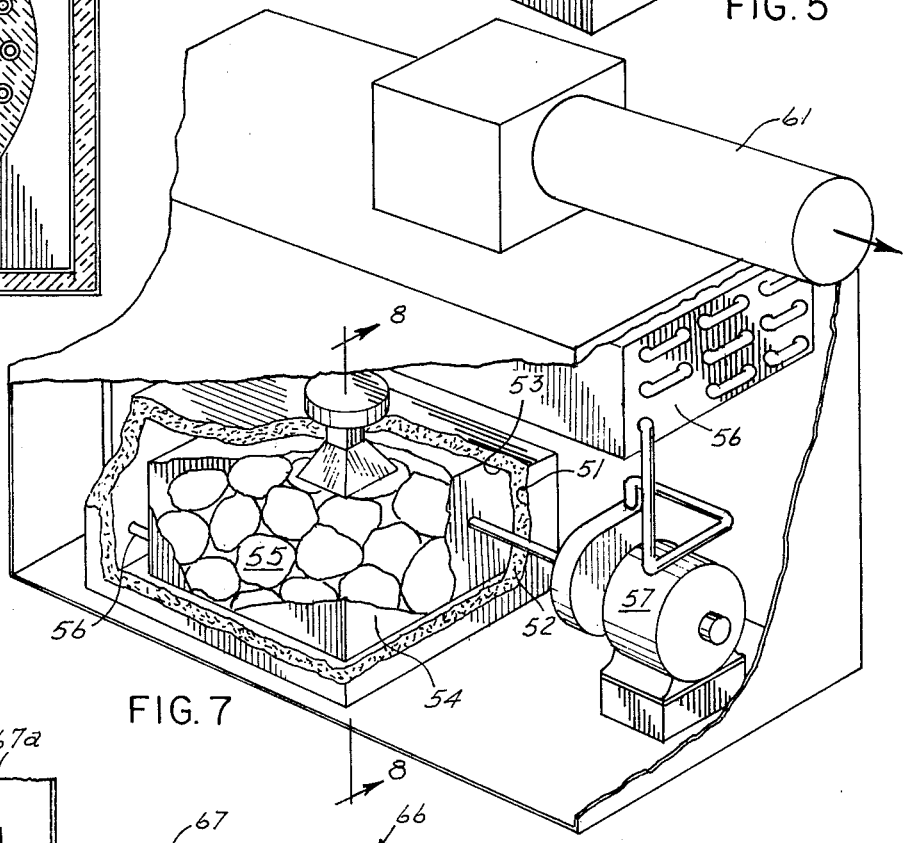
FIG. 7 is a perspective view of another form of microwave heating apparatus operated with a liquid flowing over heated bodies and with a radiator as a part thereof.

Referring now to FIGS. 7 and 8, the microwave heating apparatus shown again comprises a source of microwave energy 36 and a wave guide 37, this time mounted on the top of a housing comprised of outer walls 51, a layer of heat insulation 52 and inner walls 53 defining an inner absorptive chamber. Within the absorptive chamber there is disposed a container 54 with imperforate walls made of a microwave permeable material such as plastic which in turn contains a plurality of microwave energy absorbent bodies 55. The container 54 has a fluid inlet pipe 56 and a fluid outlet pipe 58. In this form a fluid such as water is passed through the inner container 54, and the bodies 55 which are heated by the microwave energy conduct heat to the fluid. The heated fluid may be pumped by a pump through a pipe system as shown in FIG. 1 to be radiated as heat in a room or, in the alternative, be coupled to a radiator system. In the form shown in FIGS. 7 and 8 a radiator system 50 is constructed as a part of the same unit. Here a pump 57 pumps the heated fluid from pipe 59 into the radiator system 50 via a pipe 59 and the fluid is returned from the radiator to pipe 56 via pipe 60. The heated air from the radiator is moved by a suitable blower from the radiator into a duct 61 of a duct system of a building such as the one described more fully hereinafter.

Figure 11:
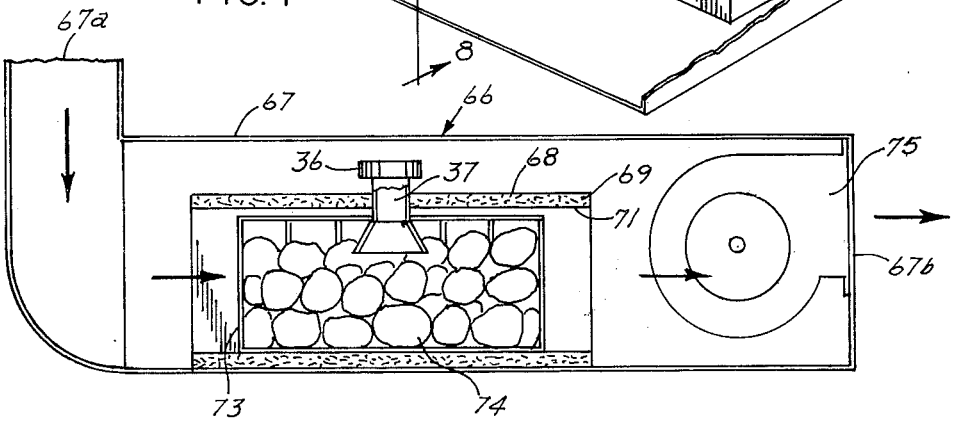
FIG. 11 is a vertical sectional view through the apparatus of FIG. 10.

In another form of the invention illustrated in FIGS. 9, 10 and 11 there is shown the building 11 having a lower level room 12 and an upper level room 13 equipped with an electric outlet 14, as was previously illustrated in FIG. 1. This building is shown with an air duct 62 having an outlet 63 for passing air into the room, a return air inlet 64 receiving air from the room, and an associated return duct 65 connected to the microwave heating apparatus 66.

This microwave heating apparatus 66 has an outer housing 67 forming a duct for the movement of heated air with an inlet 67*a* and an outlet 67*b*. Within the outer housing 66 there is provided an inner housing made up of outer walls 68, inner heat insulation 69, inner walls 71 defining an absorptive chamber, a source of microwave energy 36, and a wave guide 37 mounted on the top of the inner housing. Inside the absorptive chamber there is a basket-like container 73 having walls of a wire mesh construction with microwave absorbent bodies 74 supported in the container. The absorbent bodies are heated by the microwave energy and air is circulated by a blower 75 over the bodies to be heated and forced into the duct system to heat the room.

The absorbent bodies 55 and 74 described herein may be certain rocks that have good microwave energy properties and are arranged with spaces therebetween to permit the fluid medium, liquid or gas, to circulate therethrough and absorb heat. A preferred shape would be spherical and the size may be related to the frequency of the microwave energy for maximum absorption. A cast iron or poly iron material may be used. The body 45 preferably is cast of a solid mineral or composite mineral which have been found to have an exceptional response to microwave energy.

An alternative heating apparatus to that shown in FIGS. 10 and 11 for use in combination with a forced air system is to provide an arrangement like that shown in the form of FIGS. 5 and 6 using an arrangement of outer double-walled housing and a solid absorbent body with pyramid-like projections projecting toward and spaced from the source of microwave energy but without the pipe sections 47. In this alternative form there is provided an air inlet into the housing as through the wall from above the view of FIG. 6 and an air outlet as through the wall from below the view of FIG. 6 so that the air is forced into the chamber over the solid heated body, particularly between the pyramid-shaped projections and the source of microwave energy, and then through a duct system like that illustrated in FIG. 9.

The above described methods and apparatus therefore accomplish heating of a space using microwave energy and the heating of a fluid medium passed through a chamber that both absorbs and contains the energy. The fluid medium passed through the chamber is used to transfer the heat generated to the space or area to be heated. The fluid medium is directed so as to directly receive the energy and be heated or pass over a heated absorptive material that is heated by molecular heating. The methods and apparatus described herein afford a significant saving of energy, do not require venting, have no explosive agents, no flames, and do not produce toxic effects.

The dimensions for the wave guide and absorptive chamber and the location of the source of energy, wave guide and absorptive chamber are selected for maximum energy absorption and depend to some extent on the frequency of the energy source. The location of the output of the source of microwave energy relative to the absorbent substance is critical and for the parabolic shapes is at the focal point so the energy moves perpendicular to the absorbent substance.

The apparatus is compatible with solar energy systems in that it may be coupled between a solar absorber and a heat storage stage and provide heated air or water to the heat storage during those periods when the solar input is at a minimum.

Although the present invention has been described with a certain degree of particularity, it is understood that the present disclosure has been made by way of example and that changes in details of structure may be made without departing from the spirit thereof.

What is claimed is:

1. Microwave heating apparatus for heating a room and the like comprising:
   - means for generating microwave energy having a wave guide for directing said energy;
   - means defining a chamber having microwave energy reflecting wall surfaces for containing the microwave energy generated by said generating means and having heat insulation; and
   - pipe means in said chamber that are permeable to microwave energy for conveying a microwave energy absorbent liquid capable of directly absorbing and being heated by said microwave energy, said pipe means being in the form of a plurality of pipe sections arranged in a generally parabolic array in said chamber with said generating means located at approximately the focal point of said array and with said wall surfaces reflecting microwave energy to said liquid to enhance the absorption of said microwave energy by said liquid to heat said liquid as said liquid is passed through said chamber.

2. Microwave heating apparatus as set forth in claim 1 wherein said chamber has a pair of sources of microwave energy and a pipe means for conveying said fluid medium via said chamber there being a parabolic array of pipe sections located at approximately the focal point of each of said sources of microwave energy whereby said fluid medium is heated by each of said pair of sources of microwave energy.

3. Microwave heating apparatus for heating a room and the like comprising:
   - means for generating microwave energy having a wave guide for directing said energy;
   - means defining a chamber having microwave reflecting wall surfaces for containing the microwave energy generated by said generating means and having heat insulation; and
   - a microwave absorbent body containing pipe means in said chamber that is of a heat conductive material for conveying a fluid, said body arranged in a generally parabolic configuration in said chamber with said generating means located at approximately the focal point of said body and with said wall surfaces reflecting microwave energy to said body to enhance the absorption of said microwave energy by said body to heat said body, said body transferring the absorbed heat to said fluid carried in said pipe means.

4. Microwave heating apparatus as set forth in claim 3 wherein said body has a plurality of pyramid-shaped surfaces receiving said energy from said generating means.

5. In a microwave heating system for a room serviced by a heat distribution system, said heating system comprising, in combination:
   - means for radiating microwave energy having a wave guide for directing said energy;
   - energy absorbent and transfer means including a microwave energy absorbent liquid in a chamber having microwave energy reflecting wall surfaces for containing the microwave energy generated by said generating means and having heat insulation; and
   - pipe means in said chamber that are permeable to microwave energy for conveying said microwave energy absorbent liquid capable of directly absorbing and being heated by said microwave energy, said pipe means being in the form of a plurality of pipe sections arranged in a generally parabolic array in said chamber with said generating means located at approximately the focal point of said array and with said wall surfaces reflecting microwave energy to said liquid to enhance the absorption of said microwave energy by said liquid to heat said liquid, said liquid receiving and converting said microwave energy to heat within the liquid from which the heat is transferred to be passed into said heat distribution system.

6. A method of heating a room and like space comprising the steps of:

generating microwve energy that is directed through a wave guide;

radiating said microwave energy into a chamber having microwave energy reflecting wall surfaces for containing the microwave energy generated by said generating means and having heat insulation; and confining a fluid medium to a flow path arranged in a generally parabolic array in said chamber with the source of said generated microwave energy at approximately the focal point of said array to enhance the absorption of said microwave energy by said liquid as said liquid is passed through said chamber.

* * * * *